US007337773B2

(12) United States Patent
Simo et al.

(10) Patent No.: US 7,337,773 B2
(45) **Date of Patent: *Mar. 4, 2008**

(54) ELECTRICALLY ACTIVATED ARCHERY COMPONENT

(75) Inventors: Miroslav A. Simo, Riverside, IL (US); Robert S. Mizek, Downers Grove, IL (US); Frank A. Harwath, Naperville, IL (US); Christopher A. Kozlik, Schaumburg, IL (US); Gregory C. Smith, Geneva, IL (US)

(73) Assignee: New Archery Products Corp., Forest Park, IL (US)

( * ) Notice: Subject to any disclaimer, the term of this patent is extended or adjusted under 35 U.S.C. 154(b) by 42 days.

This patent is subject to a terminal disclaimer.

(21) Appl. No.: 11/031,980

(22) Filed: Jan. 6, 2005

(65) Prior Publication Data

US 2006/0011189 A1 Jan. 19, 2006

Related U.S. Application Data

(63) Continuation-in-part of application No. 10/889,968, filed on Jul. 13, 2004.

(51) Int. Cl.
*F41B 5/22* (2006.01)

(52) U.S. Cl. ..... 124/44.5; 124/86

(58) Field of Classification Search ..... 124/32, 124/44.5, 86, 88

See application file for complete search history.

(56) References Cited

U.S. PATENT DOCUMENTS

| | | | | |
|---|---|---|---|---|
| 3,871,352 | A | 3/1975 | Stanislawski et al. | |
| 4,343,286 | A | 8/1982 | Thacker | |
| 4,572,153 | A | 2/1986 | MacPherson | |
| 4,865,007 | A | 9/1989 | Saunders | |
| 5,205,268 | A | 4/1993 | Savage | |
| 5,243,957 | A * | 9/1993 | Neilson | 124/88 |
| 5,415,154 | A | 5/1995 | Angeloni | |
| 5,494,023 | A * | 2/1996 | Kolak | 124/35.2 |
| 5,503,136 | A | 4/1996 | Tone | |
| 5,606,961 | A | 3/1997 | Basik et al. | |
| 6,044,832 | A | 4/2000 | Piersons, Jr. | |
| 6,178,959 | B1 | 1/2001 | Troncoso, Jr. et al. | |
| 6,191,574 | B1 * | 2/2001 | Dilger | 324/178 |
| 6,561,174 | B1 | 5/2003 | Afshari | |
| 2003/0024516 | A1 | 2/2003 | Mizek et al. | |
| 2003/0127083 | A1 | 7/2003 | Musacchia, Jr. | |

* cited by examiner

*Primary Examiner*—John A. Ricci
(74) *Attorney, Agent, or Firm*—Pauley Petersen Erickson

(57) ABSTRACT

An archery component mountable with respect to an archery bow. The archery component includes a sensor that senses a movement of an archery arrow with respect to the archery bow and/or a movement of the archery bow. The sensor transmits a signal, upon sensing at least one movement, to a signal processor housed within a body of the archery bow and in communication with the sensor. The signal processor receives the signal and activates the archery component in response to the received signal.

16 Claims, 11 Drawing Sheets

ELECTRICALLY ACTIVATED ARCHERY COMPONENT

CROSS REFERENCE TO RELATED APPLICATION

This Patent Application is a continuation-in-part patent application of U.S. patent application Ser. No. 10/889,968, filed on Jul. 13, 2004 which is the co-pending parent application and which is incorporated by reference herein and is made a part hereof, including but not limited to those portions which specifically appear in this Patent Application.

BACKGROUND OF THE INVENTION

1. Field of Invention

This invention relates generally to an archery component mountable to an archery bow and, more particularly, to an electrically activated archery component.

2. Discussion of Related Art

Archery components, such as arrow rests, noise dampeners, vibration dampeners and arrow sights, have been developed to improve a flight accuracy of an arrow as it is launched from an archery bow. Such archery components are activated to move within a narrow time frame, typically only a few milliseconds. Many conventional archery components include mechanical elements, such as strings, cables and/or linkages to accomplish this movement, each of which results in an undesirable increased complexity. Further, these archery components may be difficult to attach to the archery bow and do not work with every type of archery bow.

As an example, a known arrow rest, sometimes referred to as a "fall away" arrow rest, supports the arrow with prongs or another supporting structure. When launching the arrow, the supporting structure withdraws before the fletching vanes on the aft end portion of the arrow can contact the arrow rest. However, when the launched arrow begins to move with respect to the arrow rest, inertia causes the support structure to move relatively slowly. During this time, the arrow should be supported by the arrow rest. As the arrow accelerates, the arrow rest should move out of the arrow flight path to prevent contact between the fletching and the arrow rest. Therefore, the arrow rest must be activated so that the support structure moves within a narrow time frame, typically only a few milliseconds. Current fall away arrow rests include strings, cables and/or linkages to accomplish this movement, each of which results in an undesirable increased complexity. Further, the current fall away arrow rests are difficult to attach to the archery bow and do not work with every type of archery bow.

It is apparent that there is a need for a simple and reliable archery component that can be used with a variety of archery bows.

SUMMARY OF THE INVENTION

It is an object of this invention is to provide an electrically activated archery component.

It is another object of this invention to provide an electronic module that is housed within a body of the archery bow for activating, driving and/or operating an archery component.

The above and other objects of this invention can be attained with an electrically activatable archery component that is mountable with respect to an archery bow. The archery component may include any desired component, such as an arrow rest, a bow limb silencer, a stabilizer, a noise dampener, a vibration dampener and/or an arrow sight, for example. The archery component includes at least one sensor that senses or detects a movement of an archery arrow with respect to the archery bow and/or a movement of the archery bow. The sensor is mountable or positionable with respect to a shaft of the archery arrow, a limb portion of the archery bow, a limb pocket, a riser portion of the archery bow, a cable, a cable slide, a cable guard, a cam, a pulley, a bow string and/or a release aid. The sensor generates a signal, such as an input signal, upon sensing or detecting a movement and transmits the signal to an electronic module housed within a body of the archery bow. Preferably, but not necessarily, the electronic module is housed within a riser portion of the archery bow. In certain preferred embodiments of this invention, at least a portion of the electronic module may be housed within a limb portion of the archery bow.

In one preferred embodiment of this invention, the electronic module includes a signal processor that communicates with the sensor. The signal processor receives the signal transmitted by the sensor and activates the archery component in response to the received signal. The electronic module may also include a receiver for receiving the input signal transmitted by the sensor. The receiver communicates with the signal processor to transmit the signal to the signal processor, which then processes the input signal and generates an output signal. The archery component is in responsive communication with the output signal and is activatable in response to the output signal. Preferably, a transducer communicates with the receiver and the signal processor to transmit the signal and/or a secondary signal to the signal processor in response to the receiver receiving the input signal from the sensor.

In one preferred embodiment of this invention, the sensor, such as an accelerometer, is mountable to a limb portion of the archery bow, and a wire electrically connects the sensor to the signal processor. The wire is routed through a passage formed in the limb portion and/or the riser portion. The passage may include a suitable depression, duct, groove, notch or slot formed in the limb portion and/or the riser portion, or a flexible adhesive backed wireway attached to the limb portion and/or the riser portion.

Preferably, the archery component includes a power source that is housed within the body of the archery bow and electrically connected to the sensor and/or the signal processor. Preferably, the power source is housed within the riser portion. The power source may include any suitably sized battery, such as a 9V or button battery. Other suitable power sources known to those skilled in the art can power the electrically activated archery component of the present invention.

In one preferred embodiment of this invention, the archery component includes an arrow rest that is mountable to an archery bow for supporting an archery arrow with respect to the archery bow. The archery component includes a sensor for sensing or detecting a movement of the archery arrow with respect to the archery bow and/or a movement of the archery bow. Preferably, but not necessarily, the sensor is mountable on or within a limb portion of the archery bow. Upon sensing a movement, the sensor transmits a signal to the signal processor. The signal processor is preferably housed within a riser portion of the archery bow, and in communication with the sensor. The signal processor receives the signal from the sensor and moves the arrow rest in response to the received signal. For example, the archery component may include a release element operatively connected to the signal processor that is activatable to move the arrow rest between an arrow support position and an arrow release position in response to the received signal. Preferably, the release element includes a solenoid operatively connected to the arrow rest to move the arrow rest support prongs.

The sensor may be electrically connected to the electronic module housing the signal processor with a wire positioned within a passage formed in the limb portion and routed through a passage formed in the riser portion. Preferably, but not necessarily, at least a portion of the wire is housed within a wireway that can be adhesively attached to or positioned within the passage in the limb portion and/or the riser portion. The archery component also includes a power source preferably housed within the riser portion of the archery bow, and operatively connected to the signal processor.

Other objects and advantages of this invention are apparent to those skilled in the art, in view of the following detailed description taken in conjunction with the appended claims and drawings.

DETAILED DESCRIPTION OF THE INVENTION

Figure 1:
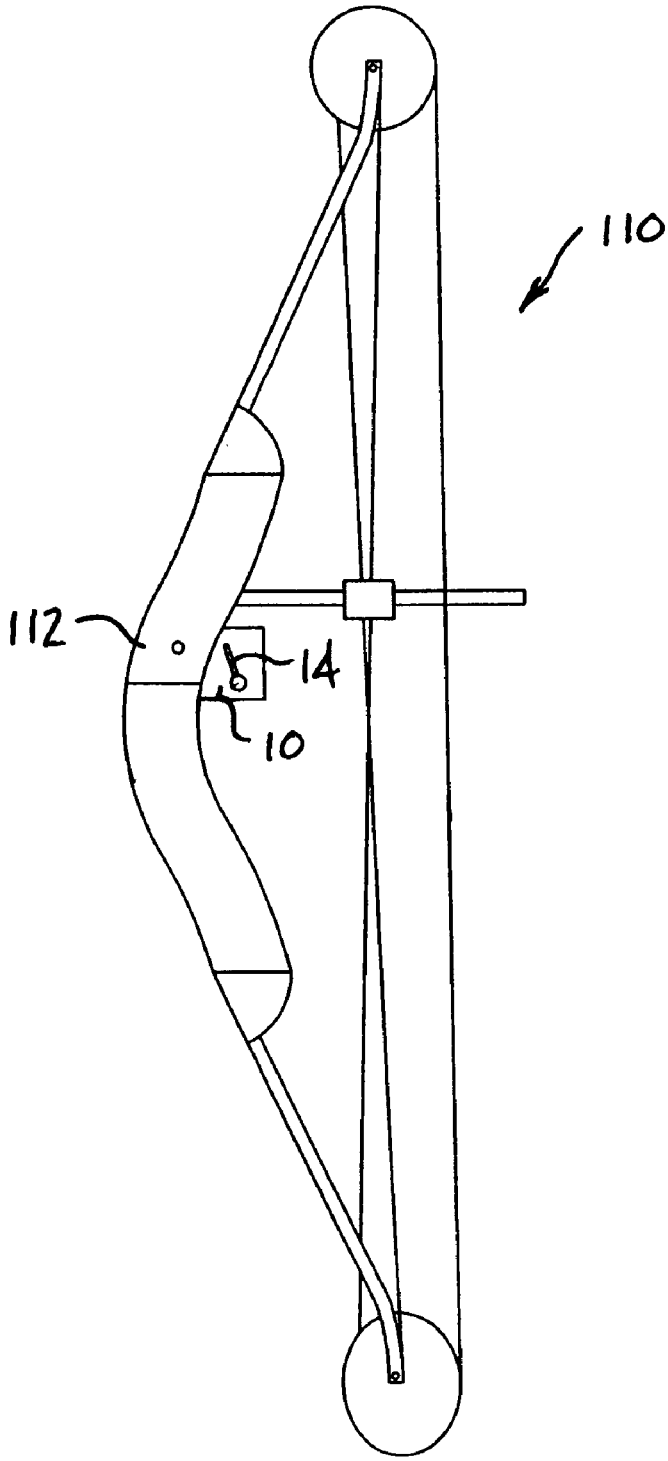
FIG. 1 is a side view of an electrically activated arrow rest mounted to an archery bow, according to one preferred embodiment of this invention.
Figure 2:
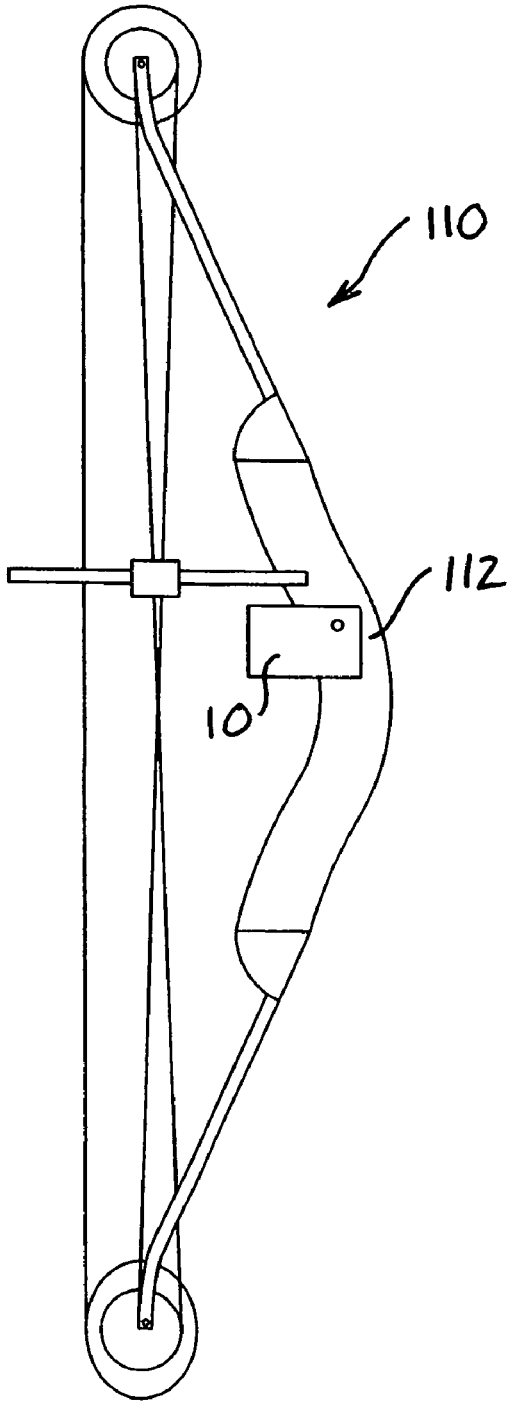
FIG. 2 is an opposite side view of the electrically activated arrow rest shown in FIG. 1, mounted to the archery bow, according to one preferred embodiment of this invention.
Figure 3:
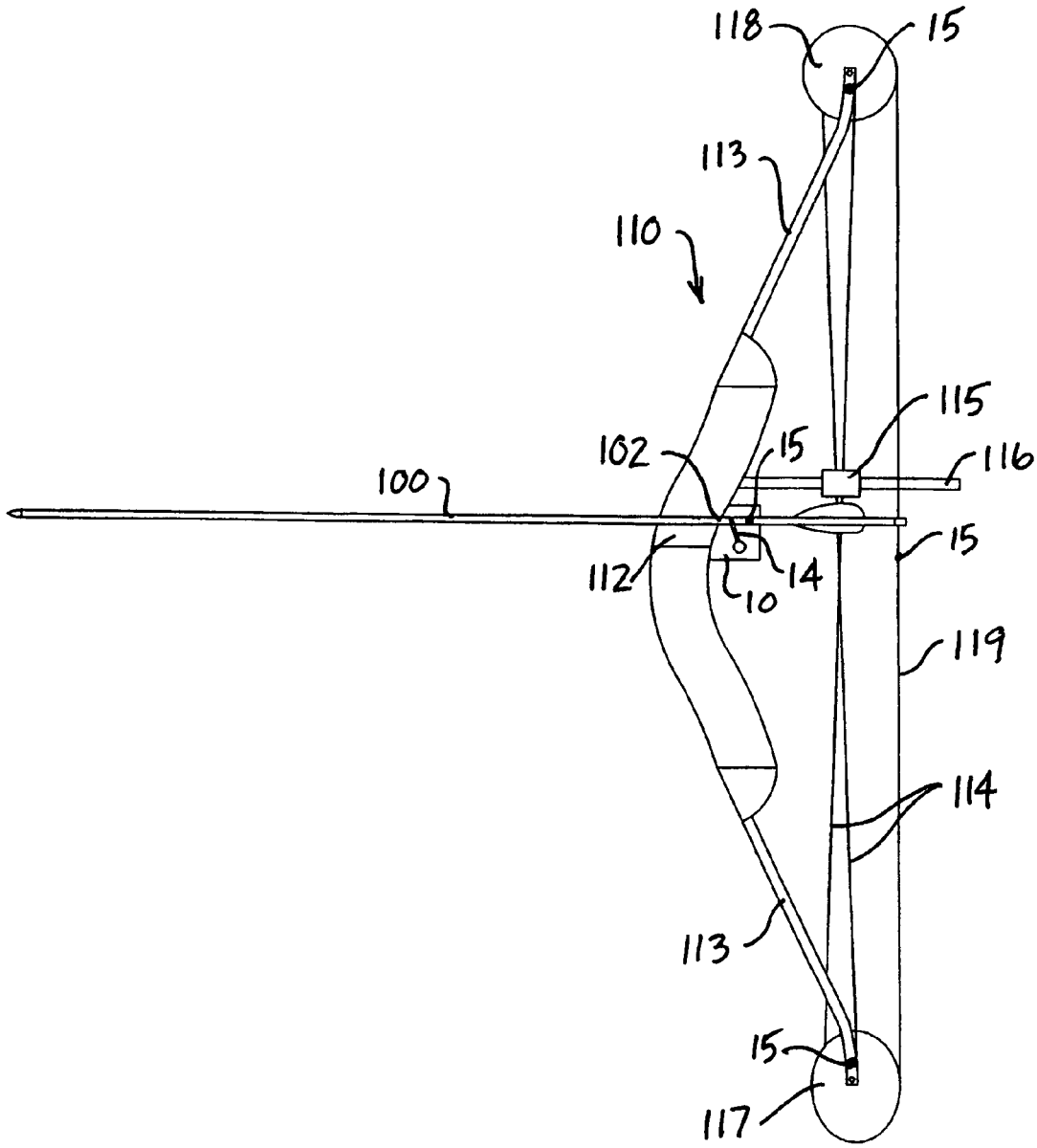
FIG. 3 is a side view of an electrically activated arrow rest mounted to an archery bow and supporting an archery arrow, according to one preferred embodiment of this invention.
Figure 4:
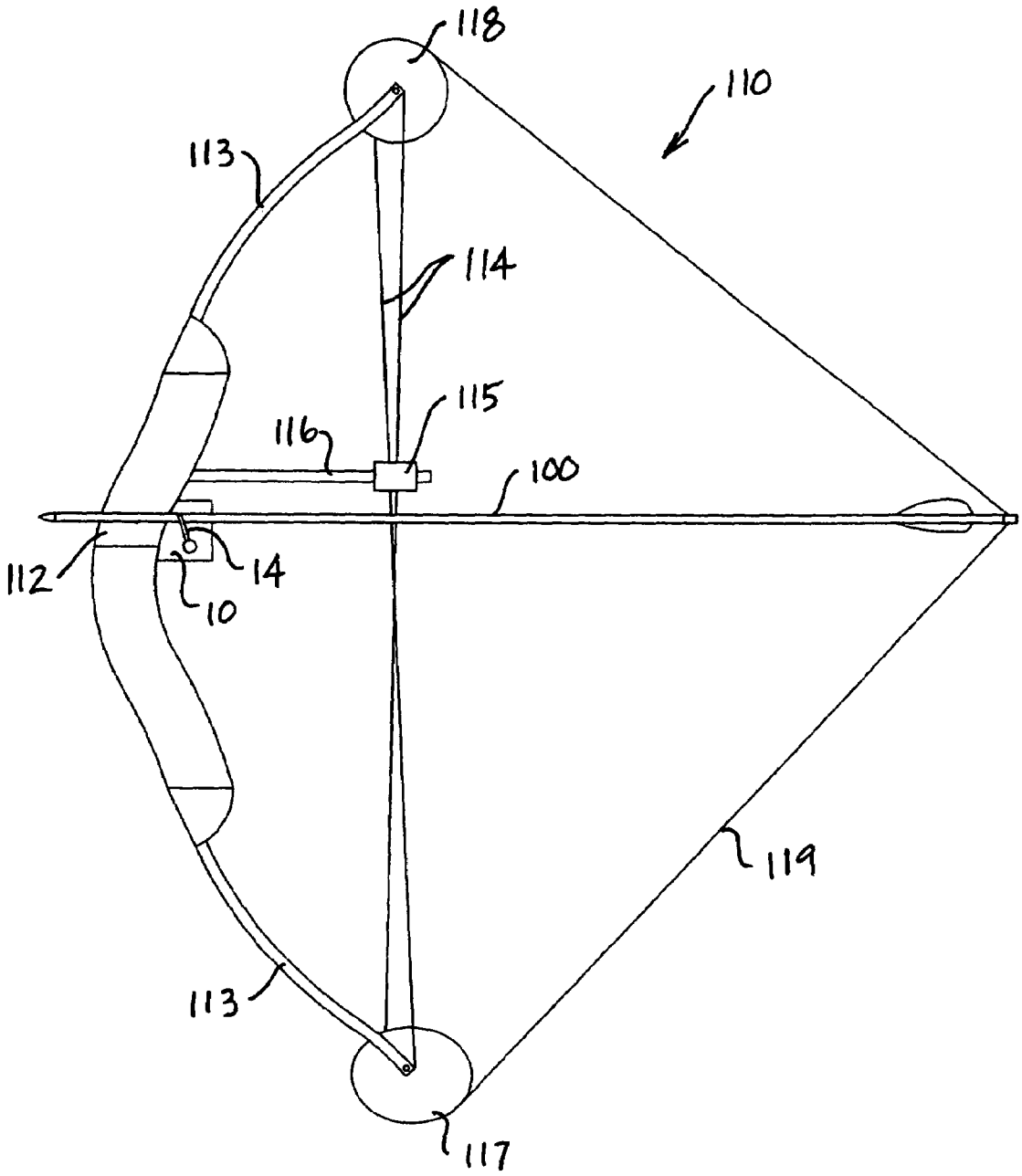
FIG. 4 is a side view of an electrically activated arrow rest mounted to an archery bow and supporting an archery arrow at a drawn position, according to one preferred embodiment of this invention.
Figure 5:
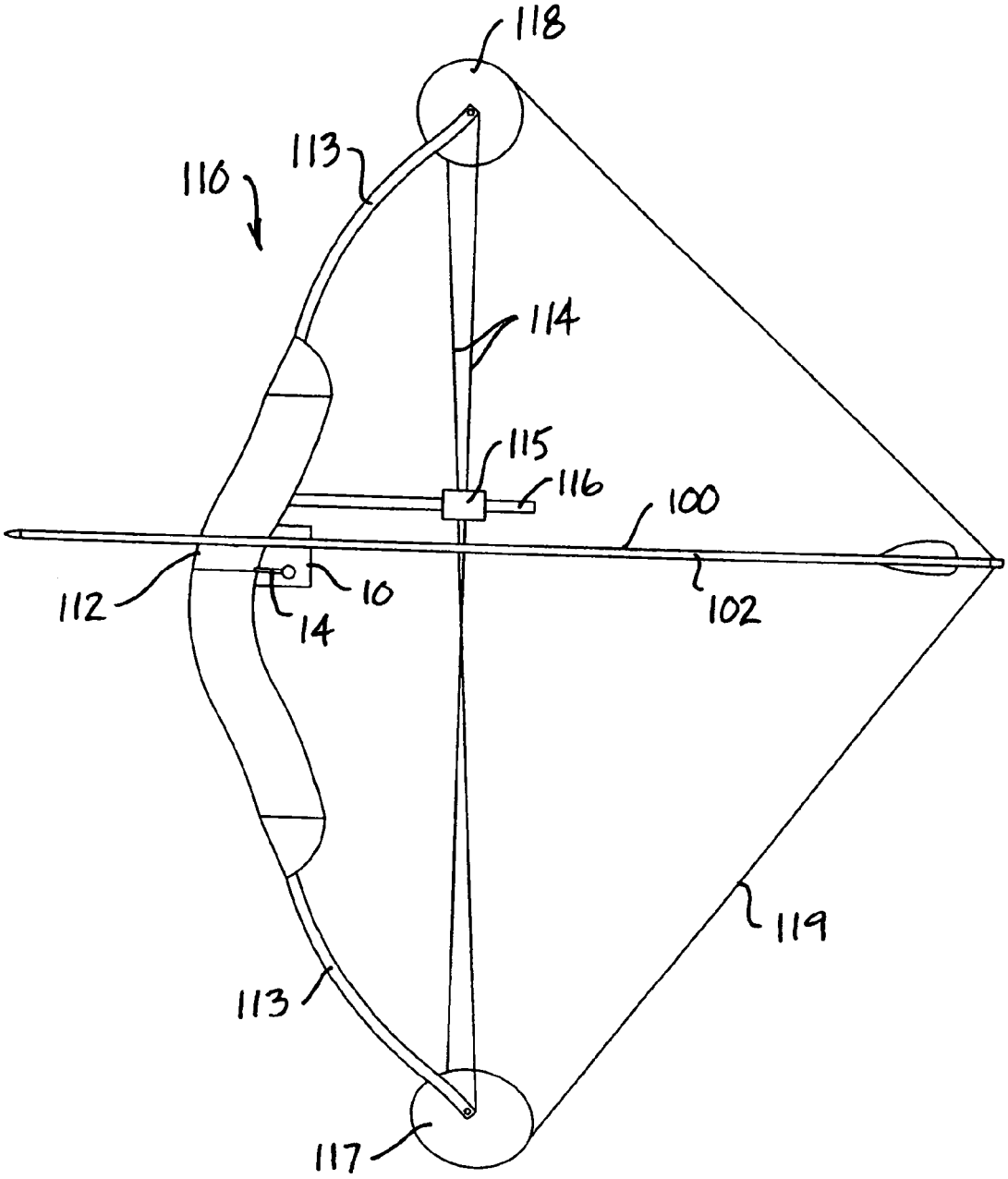
FIG. 5 is a side view of an electrically activated arrow rest mounted to an archery bow in an arrow release position, according to one preferred embodiment of this invention.
Figure 6:
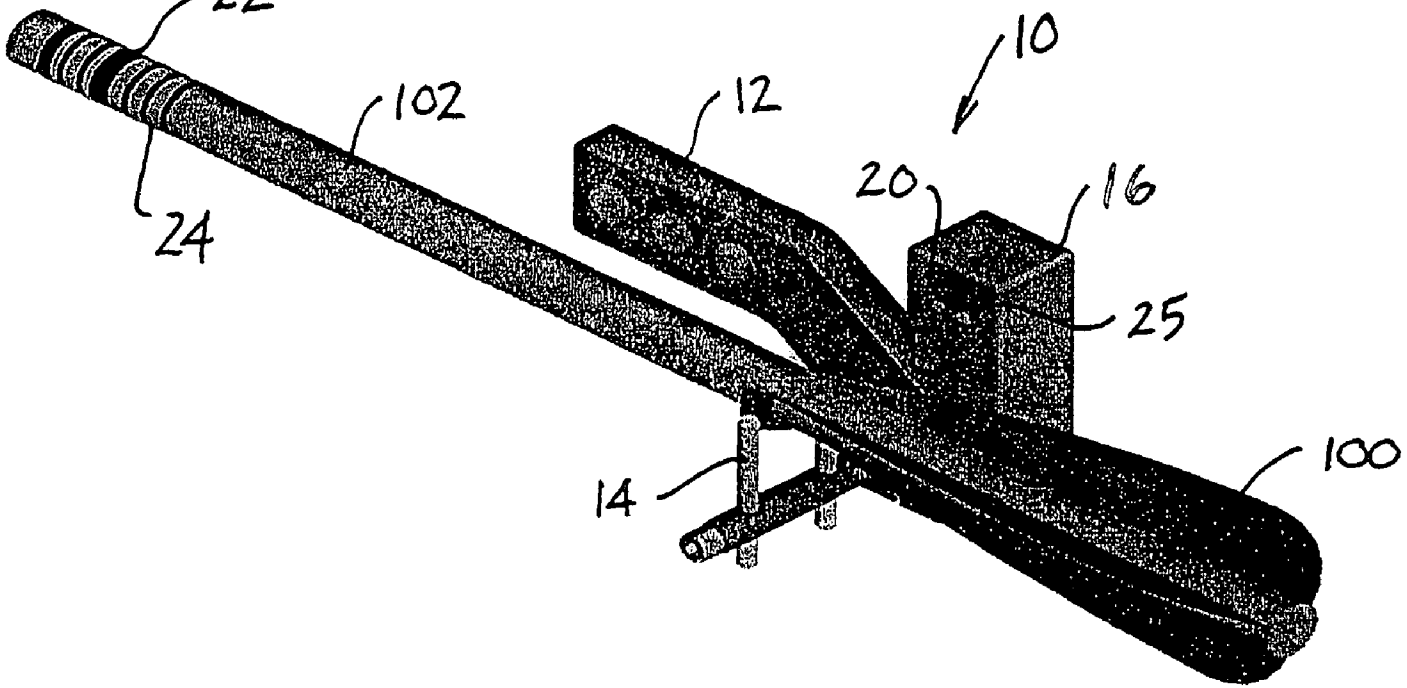
FIG. 6 is a perspective side view of an electrically activated arrow rest, according to one preferred embodiment of this invention.

Referring to FIGS. 1-8, this invention provides an arrow rest 10 that is mountable to an archery bow 110 for supporting an archery arrow 100 with respect to the archery bow 110. For example, as shown in FIG. 6, arrow rest 10 includes a bracket 12 for mounting or connecting arrow rest 10 to archery bow 110. Arrow rest 10 can be mounted or connected to any portion of the archery bow, such as at a riser portion 112 of the archery bow. Further, arrow rest 10 can be mounted or connected above, below, behind or in front of the riser portion. With arrow rest 10 at an arrow support position, as shown in FIGS. 3, 4 and 6, archery arrow 100 can be positioned on and supported by support prongs 14 of arrow rest 10. Preferably, arrow rest 10 includes two cooperating support prongs 14. However, it should be apparent to those skilled in the art and guided by the teachings herein that arrow rest 10 can include one or more support prongs 14.

In one preferred embodiment of this invention, arrow rest 10 can be activated in response to or upon detection of a motion or movement of any part, component or member of the archery bow using any suitable sensor, component or element. For example, a motion or movement of an archery bow component, such as a bow string, a portion of the archery bow body, a release aid and/or a trigger device initially positioned about the bow string, preferably in concert with a motion or movement of the archery arrow shaft 102 with respect to arrow rest 10 and/or the archery bow, can be detected or sensed to activate arrow rest 10 to move between the arrow support position and an arrow release position.

In one preferred embodiment of this invention, arrow rest 10 includes at least one suitable sensor 15, such as a suitable optical or electrical sensor, that senses or detects a first movement of the archery arrow with respect to the archery bow and/or a second movement of the archery bow, such as an arrow release movement. Sensor 15 is mountable with respect to a body of archery bow 110. For example, referring to FIG. 3, sensor 15 can be positioned, located or mounted on, about or within archery arrow shaft 102, riser portion 112, a limb 113 of the archery bow, a limb pocket, a cable 114, a cable slide 115, a cable guard 116, a cam 117, a pulley 118, a bow string 119 and/or a release aid (not shown).

At the instant an archer releases a hold on the bow string, a force is applied to a nock portion of the archery arrow to accelerate the archery arrow in the release direction. Simultaneously, the archery bow limbs accelerate forward, releasing stored energy to provide the force required to accelerate the archery arrow. Thus, the initial movement during launch of the archery arrow is essentially the simultaneous movement of the archery arrow, the bow string and the archery bow limbs. As the archery arrow continues to move, the archery bow cams, cables and cable slide move. Finally, the reaction force of the arrow launch is sufficient to move the heaviest portion of the archery bow in a direction toward the archer's hand. Therefore, in accordance with preferred embodiments of this invention, the movement of the archery arrow and/or the movement of a component of the archery bow that moves in sequence with the archery arrow can be sensed and the arrow rest can be activated to remove the support prongs 14. Sensing the movement of the archery arrow and/or the movement of a component of the archery bow that moves in sequence with the archery arrow provides increased time for moving support prongs 14 away from the archery arrow flight path.

Suitable sensors include but are not limited to phototransistors, photodiodes and suitable light sensing electrical components capable of receiving a direct beam of light and/or a reflected beam of light; magnetic sensors, including coils and magnetically permeable materials; metallic and piezoresistive strain gages; dynamic, capacitive and piezoelectric accelerometers; dynamic, electret and condenser microphones; proximity sensors; and micro-switches.

In one preferred embodiment of this invention, with the archery arrow positioned with respect to arrow rest 10, sensor 15 detects or senses a first movement of the archery arrow with respect to arrow rest 10 and/or the archery bow, and/or a second movement of the archery bow. For example, sensor 15 may sense an arrow release movement of bow string 119 and/or an arrow release movement of limb 113 in concert with a movement of archery arrow shaft 102 with respect to archery bow 110. Preferably, sensor 15 senses the bow string movement and/or the limb movement upon release of the bow string from the holding position to launch the archery arrow. The bow string may be initially held in the holding position using an archer's finger, a release aid and/or a trigger device, for example. Sensor 15 transmits a signal to an activating circuit in communication with sensor 15 upon sensing the first movement and/or the second movement, such the arrow release movement of the bow string.

In one preferred embodiment of this invention, the activating circuit includes a signal processor 40 discussed in further detail below. The signal may be transmitted to signal processor 40 using any suitable transmission means or mechanism, such as a light source, an optical source, a magnetic field, a vibration, a radio wave, a hydraulic mechanism, a pneumatic mechanism, a direct connection and/or a wire, for example. It is apparent to those skilled in the art and guided by the teachings herein that other suitable transmission mechanisms can be used with the arrow rest of the present invention.

Signal processor 40 receives and processes the signal to generate a corresponding output signal to move arrow rest 10 in response to the received signal. In one preferred embodiment of this invention, arrow rest 10 includes a release element 45 operatively connected to and/or in responsive communication with signal processor 40 to move arrow rest 10 between the arrow support position and the arrow release position in response to the signal. Release element 45 is operatively connected to support prongs 14 and is actuatable to release support prongs 14 towards the arrow release position in response to the output signal. Preferably, release element 45 includes an electric motor, a linear actuator, a hydraulic piston, a pneumatic piston, a solenoid, a spring, a battery, a capacitor, an inductor, a fuel cell, a hydraulic accumulator, a supply of a compressed gas, at least one reactable chemical component and/or at least one combustible material.

In one preferred embodiment of this invention, any suitable combination of sensor 15, sensor position or location with respect to archery bow 110, and transmission means or mechanism can be used to actuate arrow rest 10 to move between the arrow support position and the arrow release position. For example, a sensor 15 including an accelerometer can be positioned within archery arrow shaft 102. Sensor 15 may transmit a signal using radio wave transmission to the activating circuit to move support prongs 14 from the arrow support position to the arrow release position using energy stored in a compressed gas. Alternatively, a sensor 15 including a strain gage can be positioned within a limb pocket of archery bow 110. Sensor 15 may transmit a signal to signal processor 40 using a direct light beam to move support prongs 14 from the arrow support position to the arrow release position using energy supplied by a battery connected to a linear actuator.

In one preferred embodiment of this invention, arrow rest 10 includes an electronic module 16. A suitable battery 17, as is known, is housed or contained within electronic module 16 to power the electronic module components. Preferably, battery 17 includes a shut-off mechanism to conserve battery life when arrow rest 10 is not in use. Electronic module 16 is preferably made of a weather-resistant material and/or sealed to prevent damage to the electrical components of arrow rest 10 due to moisture and other environmental elements.

Figure 7:
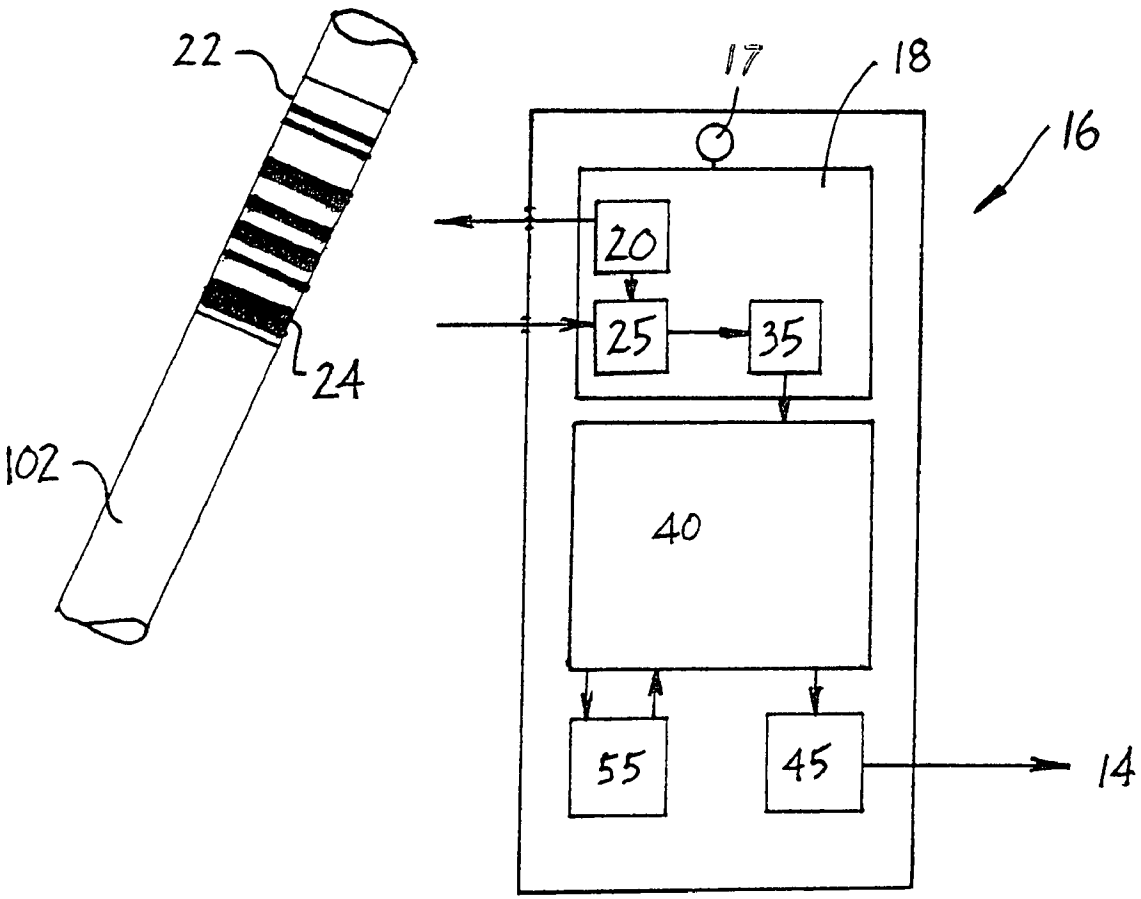
FIG. 7 is a block diagram of an electronic module of an arrow rest schematically showing the electrical components of the arrow rest, according to one preferred embodiment of this invention.
Figure 8:
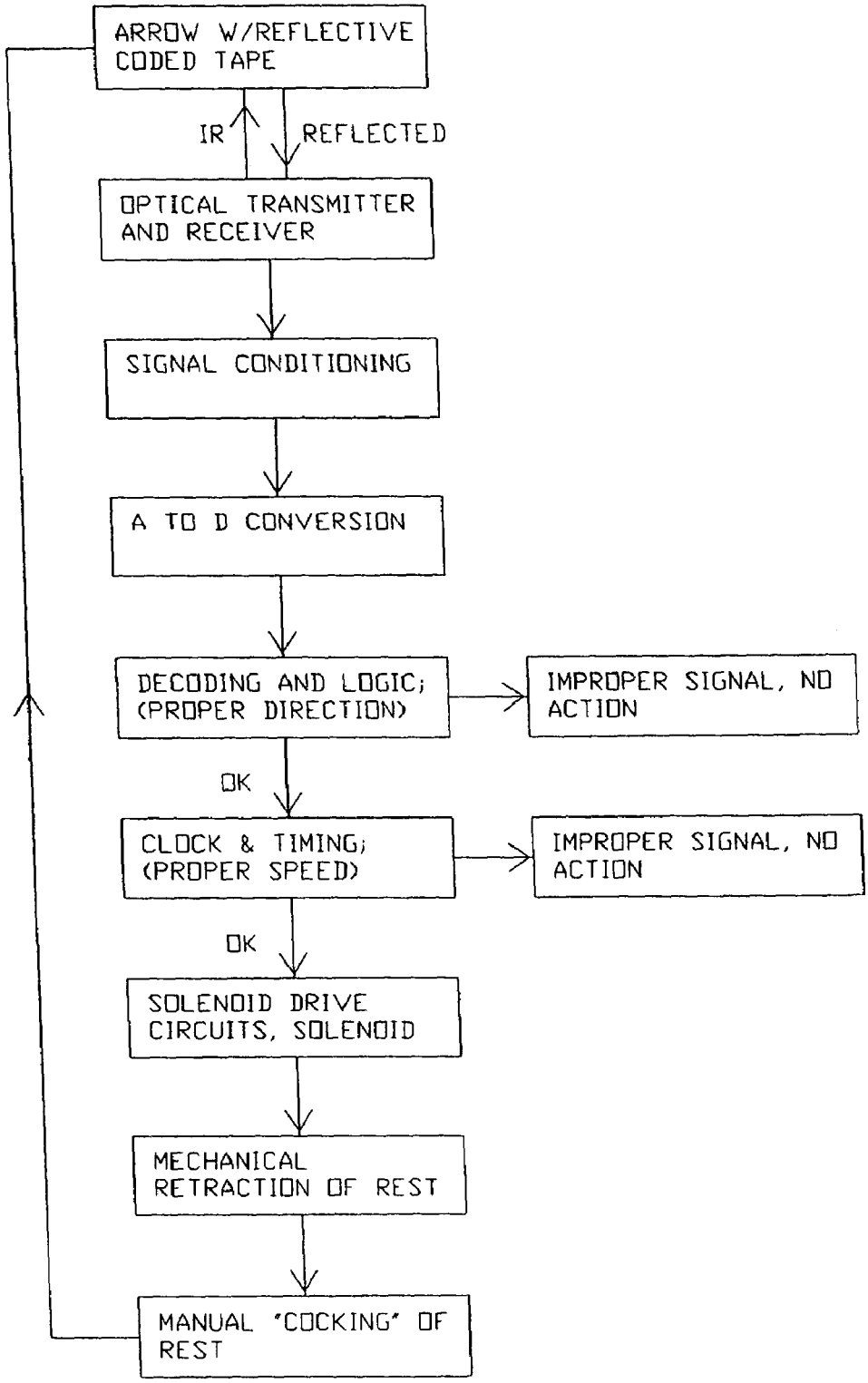
FIG. 8 is a flow chart showing processes involved in the operation of an electrically activated arrow rest, according to one preferred embodiment of this invention.

Referring to FIGS. 6-8, electronic module 16 preferably houses or contains a suitable sensor, such as an optical sensor 18, mountable with respect to a body of the archery bow. As shown schematically in FIG. 7, optical sensor 18 includes an emitter 20 for emitting a light signal at a shaft 102 of archery arrow 100 positioned on arrow rest 10. In one preferred embodiment of this invention, emitter 20 includes a light-emitting diode (LED), such as an infrared light-emitting diode, that emits a light signal at archery arrow shaft 102 positioned on arrow rest 10. Other suitable emitters known in the art can be used to emit the light signal towards shaft 102. As shown in FIG. 6, archery arrow shaft 102 includes a reference mark 22 affixed to shaft 102. Preferably, reference mark 22 is made of a reflective material. For example, reference mark 22 may include a reflective tape material bonded, such as by using an adhesive, about shaft 102 at a determined or set location on shaft 102. Reference mark 22 is preferably positioned on shaft 102 at the determined or set location depending upon the archer's preferred archery bow set-up or configuration. In one preferred embodiment of this invention, reference mark 22 includes a magnetic sensing strip that cooperates with a magnetic release element to actuate release element 45 and move support prongs 14 from the arrow support position to the arrow release position.

In one preferred embodiment of this invention, reference mark 22 includes a bar code 24, as shown in FIGS. 6 and 7. Bar code 24 can include any suitable pattern of markings, circumferential lines or bars and/or any suitable sensible or detectable indicia. Preferably, bar code 24 contains a plurality of asymmetric circumferential bars, as shown in FIGS. 6 and 7. As archery arrow 100 is moved with respect to arrow rest 10 to a drawn or holding position, emitter 20 emits a light signal or another suitable signal at shaft 102. At the holding position, the light signal emitted from emitter 20 against reference mark 22 is reflected by reference mark 22 at electronic module 16. The term holding position as referred to throughout the specification and in the claims is defined as a position of the archery arrow with respect to the archery bow after the archery arrow has been drawn and is temporarily held and supported by the arrow rest in order for the archer to aim the archery arrow at a target, for example.

Optical sensor 18 includes a receiver 25, which senses or detects the reflected light signal. For example, in one preferred embodiment of this invention, receiver 25 detects or senses bar code 24 as the light signal transmitted by emitter 20 is reflected at receiver 25. Therefore, receiver 25 senses reference mark 22 on shaft 102, which indicates that the archery arrow 100 is at the holding position. A transducer 35 in signal communication with receiver 25 transmits a position signal to signal processor 40, in response to receiver 25 detecting or sensing reference mark 22 and indicating that the archery arrow 100 is in the holding position. As shown in FIG. 7, signal processor 40 is in communication with transducer 35 and receives the position signal.

Signal processor 40 receives and processes the transmitted position signal to generate a corresponding electrical output signal, upon determination of a direction of an archery arrow movement and a movement speed. For example, signal processor 40 receives the position signal transmitted by transducer 35 and determines whether the archery arrow is moving in a draw direction with respect to the archery bow or a release direction, which is opposite the draw direction. Additionally, if signal processor 40 determines that the archery arrow is moving in the release direction, a speed of the archery arrow movement is measured or calculated. Based upon the direction and/or speed determinations, signal processor 40 generates and transmits a corresponding or appropriate electrical output signal, which includes either an actuating signal or a stop signal, to release element 45 in communication with signal processor 40. Preferably, but not necessarily, release element 45 is housed or contained within electronic module 16 and operatively connected to support prongs 14.

In one preferred embodiment of this invention, arrow rest 10 includes a timer or a clock 55 in communication with signal processor 40. Timer 55 measures a speed of a movement of the archery arrow with respect to the arrow rest. For example, if signal processor 40 determines that the archery arrow is moving in the release direction, then timer 55 measures or calculates the speed at which the archery arrow is moving in the release direction. A speed at or above a threshold speed represents or indicates that the archery arrow is launched from the archery bow. A speed below the threshold speed conversely represents or indicates that the archery arrow is not launched from the archery bow and is "let down" from the holding position. If the speed of the movement in the release direction is at the threshold speed, then the output signal includes an actuating signal to activate release element 45 and move support prongs 14 from the arrow support position to the arrow release position. Alternatively, if the speed of the movement in the release direction is less than the threshold speed, then the output signal includes a stop signal preventing movement of support prongs 14 from the arrow support position to the arrow release position. Further, if signal processor 40 determines that the archery arrow is moving in the draw direction, then the output signal includes a stop signal preventing movement of support prongs 14 from the arrow support position to the arrow release position. With the stop signal, the drawn archery arrow can be let down or released without activating arrow rest 10 and preferably without undesirable noise, if the archer decides not to launch the archery arrow from the holding position.

Preferably, release element 45 is in responsive communication with the output signal. Release element 45 is actuatable to release support prongs 14 between an arrow support position, as shown in FIG. 6, and an arrow release position, wherein support prongs 14 rotate or pivot in a general release direction through an angle, preferably about 90°. In other preferred embodiments of this invention, support prongs 14 may move between the arrow support position and the arrow release position along a linear path, a rotational path or a combination thereof.

Release element 45 may include any suitable electrical, magnetic and/or mechanical component, such as a magnet, a torsion spring, an extension/compression spring, an air pressure, a gear motor, an electric motor and a solenoid, acting directly or through the use of pulleys, cables, gears and/or rack and pinions, to move support prongs 14. In one preferred embodiment of this invention, release element 45 includes a spring (not shown). The spring has energy by manual activation, for example by cocking or setting arrow rest 10 in the arrow support position. Alternatively, other suitable means for setting arrow rest 10 in the arrow support position may be used, such as a gear motor, which can set arrow rest 10 in the arrow support position after the archery arrow is launched from arrow rest 10, or an electrical setting element having at least one solenoid and/or at least one motor.

Referring to FIG. 8, arrow rest 10 can be electrically activated by emitting a light signal at a shaft of an archery arrow positioned within the arrow rest. The reference mark on the archery arrow shaft is sensed or detected with the archery arrow positioned within the arrow rest at a holding position. The movement of the shaft with respect to the arrow rest is detected and a direction of the movement in either a draw direction or a release direction, which is opposite the draw direction, is determined. Further, the speed of the movement in the release direction is determined and compared to a threshold speed. Based upon the direction of the movement and the speed of the movement, an output signal comprising one of a stop signal and an actuating signal is transmitted to release element 45. With the speed of the movement in the release direction at least equal to a threshold speed, the actuating signal is transmitted to release element 45 to actuate support prongs 14 to move from the arrow support position to the arrow release position.

Figure 9:
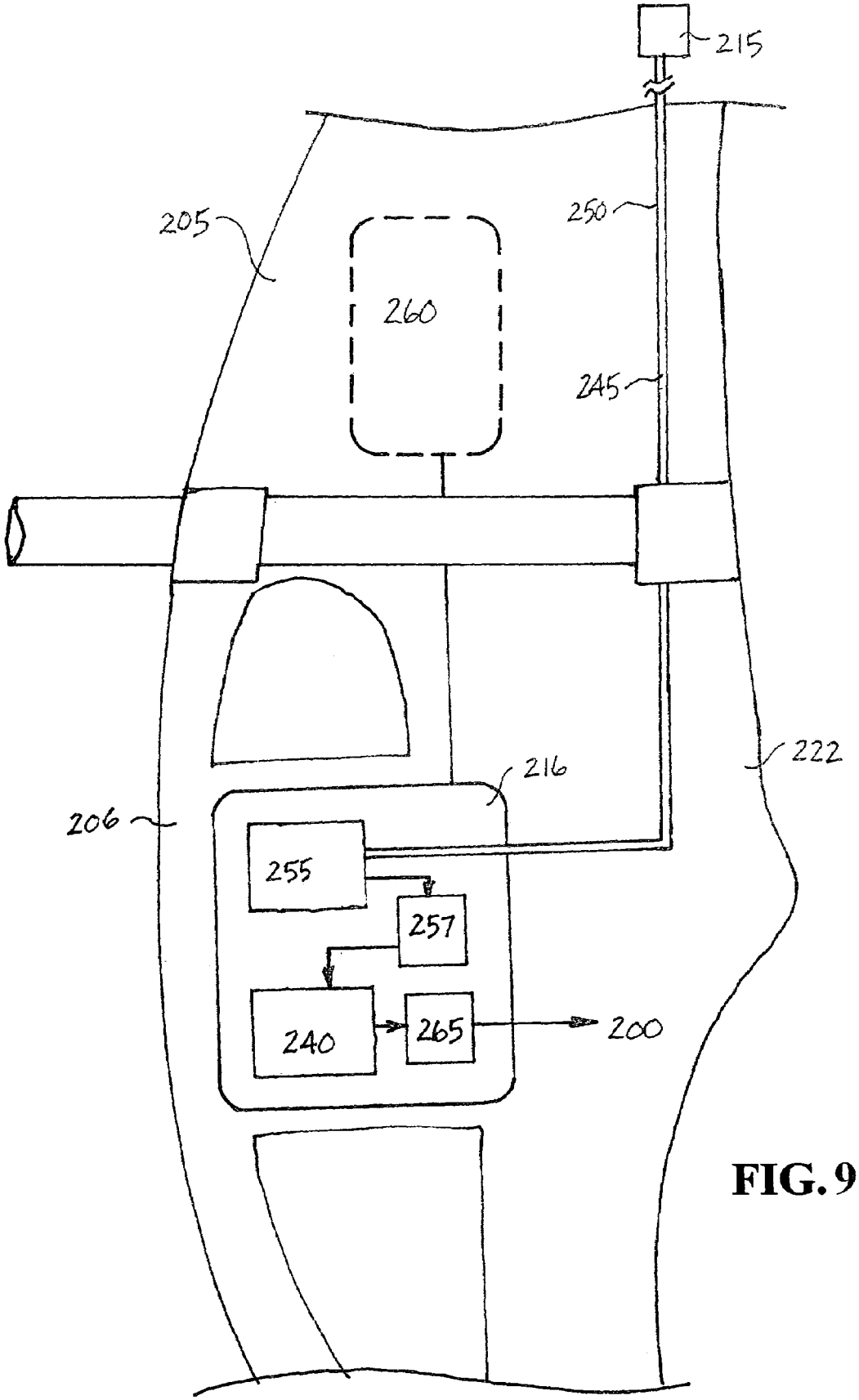
FIG. 9 is a side view of an electrically activated archery component including a block diagram of an electronic module housed within a riser portion of an archery bow, and schematically showing the electrical components of the archery component, according to one preferred embodiment of this invention.
Figure 10:
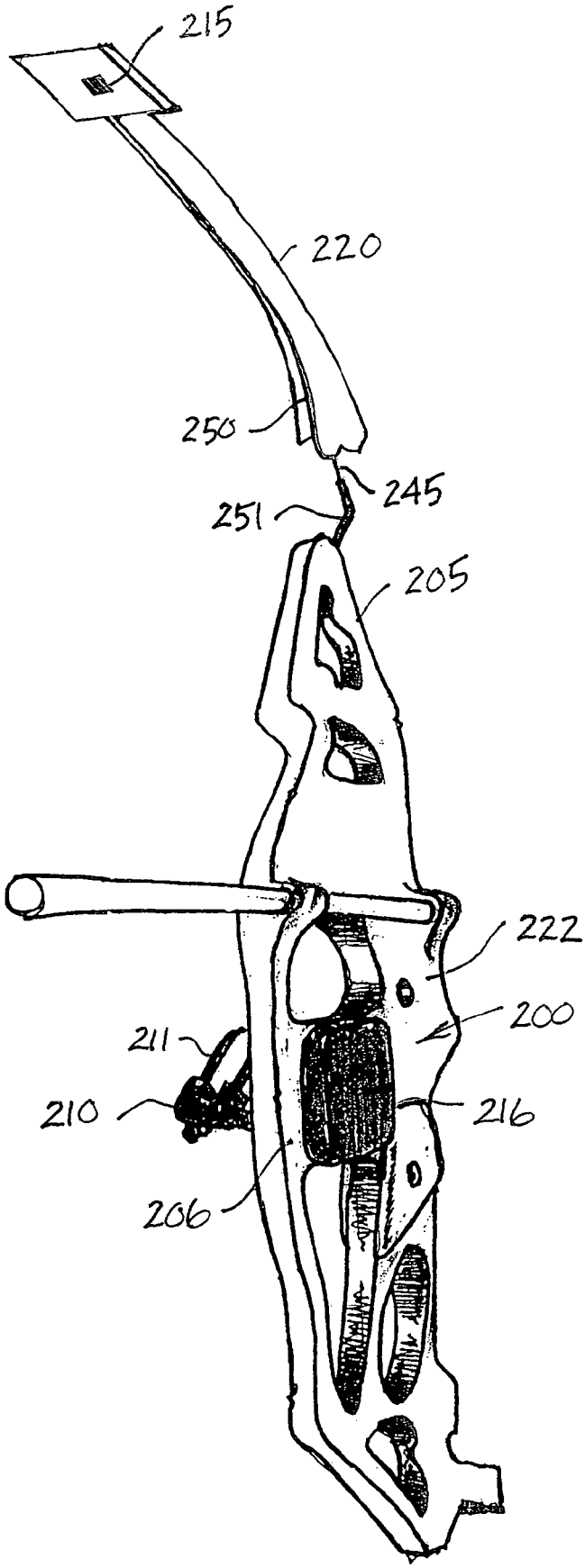
FIG. 10 is a perspective side view of an electrically activated archery component including an arrow rest, and having an electronic module housed within a body of an archery bow, according to one preferred embodiment of this invention.
Figure 11:
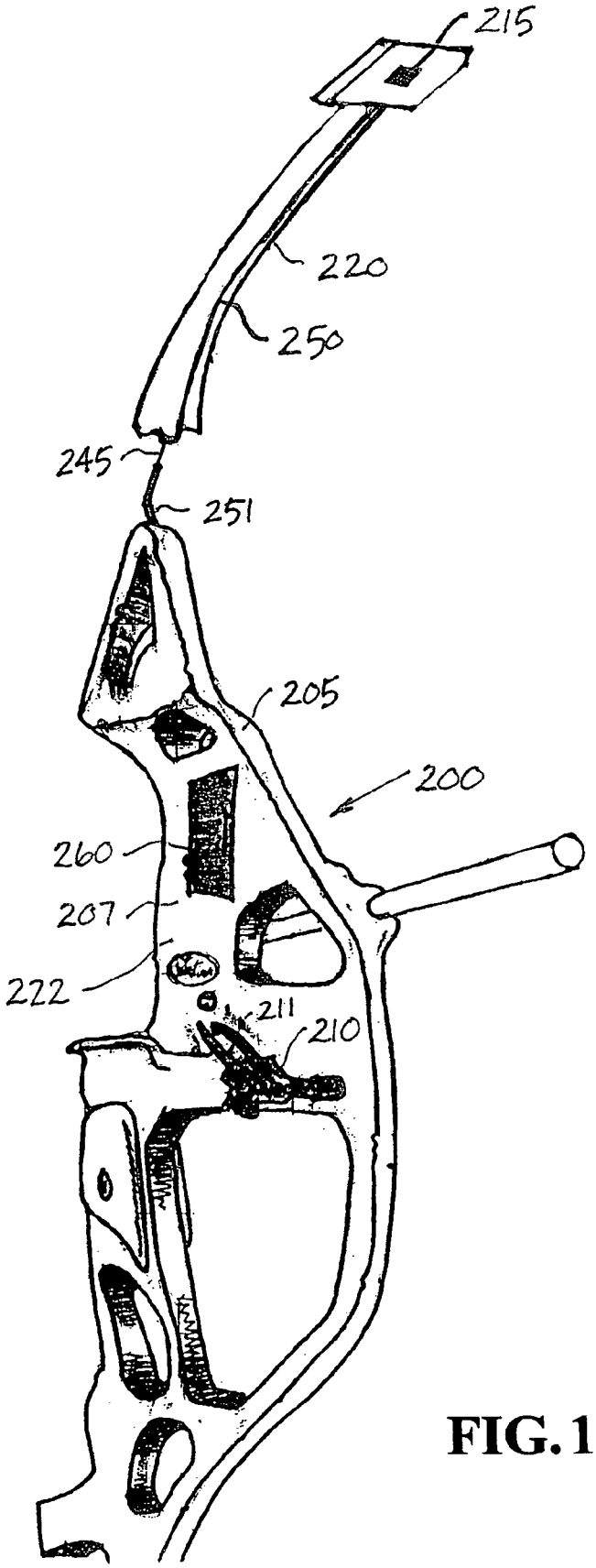
FIG. 11 is a perspective opposite side view of the electrically activated archery component of FIG. 10 including a power source housed within the body of the archery bow, according to one preferred embodiment of this invention.

Referring to FIGS. 9-11, in one preferred embodiment of this invention an archery component 200 is mountable with respect to an archery bow 205. Archery component 200 preferably includes an arrow rest 210 as shown in FIGS. 10 and 11, a bow limb silencer, a stabilizer, a noise dampener, a vibration dampener and/or an arrow sight such as a LED arrow sight. Archery component 200 can include any suitable component known in the art that can be electrically activated, driven and/or operated.

Archery component 200 includes at least one suitable sensor 215 that senses or detects a movement of the archery arrow with respect to archery bow 205 and/or a movement of archery bow 205, such as an arrow release movement. Sensor 215 is mountable with respect to a body of archery bow 205. For example, referring to FIGS. 10 and 11, sensor 215 can include an accelerometer positioned, located or mounted on, about or within a limb portion 220 of archery bow 205. Alternatively or in addition, a sensor 215 can be positioned, located or mounted on, about or within a riser portion 222 of archery bow 205, a limb pocket, a cable, a cable slide, a cable guard, a cam, a pulley, a bow string, a trigger device and/or a release aid.

Suitable sensors include but are not limited to phototransistors, photodiodes and suitable light sensing electrical components capable of receiving a direct beam of light and/or a reflected beam of light; magnetic sensors, including coils and magnetically permeable materials; metallic and piezoresistive strain gages; dynamic, capacitive and piezoelectric accelerometers; dynamic, electret and condenser microphones; proximity sensors; and micro-switches.

In one preferred embodiment of this invention, with an archery arrow positioned with respect to arrow rest 210, sensor 215 detects or senses a first movement of the archery arrow with respect to arrow rest 210 and/or archery bow 205, and/or a second movement of archery bow 205. For example, sensor 215 may sense an arrow release movement of a bow string and/or an arrow release movement of limb portion 220 in concert with a movement of an archery arrow shaft with respect to archery bow 205. Preferably, sensor 215 senses the bow string movement and/or the limb movement upon release of the bow string from the holding position to launch the archery arrow. The bow string may be initially held in the holding position using an archer's finger, a release aid and/or a trigger device, for example. Sensor 215 transmits a signal to an activating circuit in communication with sensor 215 upon sensing the first movement and/or the second movement, such as the arrow release movement of the bow string.

Archery component 200 preferably includes an electronic module 216 at least partially housed within a body of archery bow 205. For example, as shown in FIG. 10, electronic module 216 is housed within riser portion 222 of archery bow 205 and generally flush with a side surface 206 of archery bow 205. Alternatively, at least a portion of electronic module 216, including any component connected to, or contained or housed within electronic module 216, can be housed within limb portion 220. Electronic module 216 houses or contains any suitable or desired electronic element and/or component required to activate, drive and/or operate archery component 200, including but not limited to the elements and/or components discussed above in reference to electronic module 16.

Referring to FIG. 9, electronic module 216 preferably includes a signal process 240 in communication with sensor 215. Signal processor 240 receives signals transmitted from sensor 215 and activates archery component 200 in response to the received signal. The signal may be transmitted to signal processor 240 using any suitable transmission means or mechanism, such as a light source, an optical source, a magnetic field, a vibration, a radio wave, a hydraulic mechanism, a pneumatic mechanism, a direct connection and/or a wire, for example. It is apparent to those skilled in the art and guided by the teachings herein that other suitable transmission mechanisms can be used with the archery component of the present invention.

In one preferred embodiment of this invention, electronic module 216 includes a receiver 255 for receiving an input signal transmitted by sensor 215. Receiver 255 is in communication with signal processor 240. Signal processor 240 processes the input signal and generates an output signal to activate archery component 200. Archery component 200 is in responsive communication with the output signal and is activatable in response to the output signal. Electronic module 216 preferably also includes a transducer 257 that transmits a signal, such as the input signal received from sensor 215 and/or a secondary signal to signal processor 240 in response to receiver 255 receiving the input signal from sensor 215. Electronic module 216 may include any suitable element and/or component known to those skilled in the art.

As shown in FIG. 10, sensor 215 is mountable to limb portion 220 and a wire 245 electrically connects sensor 215 to signal processor 240 to transmit signals between sensor 215 and signal processor 240. Preferably, but not necessarily, at least a portion of wire 245 is routed through a passage 250 formed in limb portion 220 and/or riser portion 222. Passage 250 can include any suitable depression, duct, groove, notch or slot formed in or through limb portion 220 and/or riser portion 222. In one preferred embodiment of this invention, a flexible housing or wireway 251 can be positioned within passage 250 and/or attached to limb portion 220 and/or riser portion 222. Preferably, wireway 251 includes an adhesive backing that adheres to limb portion 220, for example, to secure wire 245 with respect to archery bow 205. Wire 245 is routed through wireway 251 and into passage 250 formed in riser portion 222.

Referring to FIG. 11, in one preferred embodiment of this invention, archery component 200 includes a power source 260 housed within the archery bow body and electrically connected to sensor 215 and/or electronic module 216. Preferably, power source 260 includes a suitable battery, such as a conventional 9V battery. It is apparent that any suitably sized battery or suitable power source known to those skilled in the art can be used as power source 260. As shown in FIG. 11, power source 260 is preferably housed within riser portion 222 of archery bow 205 and generally flush with side surface 206 and/or an opposing side surface 207 of archery bow 205. Alternatively, power source 260 can be housed within limb portion 220.

Referring further to FIGS. 10 and 11, in one preferred embodiment of this invention, archery component 200 includes arrow rest 210 mountable to archery bow 205 for supporting an archery arrow with respect to archery bow 205. Archery component 200 preferably includes a least one sensor 215 mountable with respect to a body of archery bow 205. For example, as shown in FIGS. 10 and 11, sensor 215 may include an accelerometer positioned or mounted at limb portion 220. Sensor 215 senses or detects a movement of the archery arrow with respect to archery bow 205 and/or a movement of archery bow 205. Upon sensing the movement, sensor 215 transmits a signal, such as an input signal, to electronic module 216 preferably housed within riser portion 222. Signal processor 240 is in communication with sensor 215 and receives the input signal. In response to receiving the input signal, signal processor 240 activates arrow rest 210 to move in response to the received signal.

In one preferred embodiment of this invention, wire 245 electrically connects sensor 215 to signal processor 240 and transmits the input signal from sensor 215 to signal processor 240. Preferably, at least a portion of wire 245 is positioned within passage 250 formed in limb portion 220 and routed through passage 250 formed in riser portion 222. Power source 260 is preferably housed within riser portion 222 and operatively connected to signal processor 240. A release element 265 is operatively connected to signal processor 240 and moves arrow rest 210 between an arrow support position and an arrow release position in response to the received signal. Release element 265 may include any suitable activating mechanism or component, such as an electric motor, a linear actuator, a hydraulic piston, a pneumatic piston, a solenoid, a spring, a battery, a capacitor, an inductor, a fuel cell, a hydraulic accumulator, a supply of a compressed gas, at least one reactable chemical component and/or at least one combustible material, for example.

In one preferred embodiment of this invention, release element 265 includes a solenoid operatively connected to arrow rest 210 to move arrow rest 210 in response to the output signal generated by signal processor 240. Release element 265 is in responsive communication with the output signal, and is activatable in response to the output signal to move at least one support prong 211 of arrow rest 210 between an arrow support position and an arrow release position.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An archery component mountable with respect to an archery bow, the archery component comprising:

a sensor sensing at least one of a first movement of an archery arrow with respect to the archery bow and a second movement of the archery bow, the sensor transmitting a signal upon sensing at least one of the first movement and the second movement; and a signal processor housed within a body of the archery bow and in communication with the sensor, the signal processor receiving the signal and activating the archery component in response to the received signal, and at least a portion of the signal processor housed within a limb portion of the archery bow.

2. The archery component of claim 1 comprising at least one of an arrow rest, a bow limb silencer, a stabilizer, a noise dampener, a vibration dampener and an arrow sight.

3. The archery component of claim 1 wherein the sensor comprises at least one of an optical sensor, an electrical sensor, a phototransistor, a photodiode, a light sensing electrical component, a magnetic sensor, a magnetic coil, a magnetically permeable material, a strain gage, an accelerometer, a microphone, a proximity sensor, and a microswitch.

4. The archery component of claim 1 wherein the sensor is mountable with respect to at least one of a shaft of the archery arrow, a limb portion of the archery bow, a limb pocket, a riser portion of the archery bow, a cable, a cable slide, a cable guard, a cam, a pulley, a bow string, a trigger device and a release aid.

5. The archery component of claim 1 wherein the sensor is mountable to a limb portion of the archery bow, and a wire electrically connects the sensor to the signal processor.

6. The archery component of claim 5 wherein at least a portion of the wire is routed through a passage formed in the limb portion.

7. The archery component of claim 5 wherein at least a portion of the wire is routed through a passage formed in a riser portion of the archery bow.

8. The archery component of claim 1 further comprising a power source housed within the body and electrically connected to at least one of the sensor and the signal processor.

9. The archery component of claim 8 wherein the power source comprises a battery.

10. An archery component mountable with respect to an archery bow, the archery component comprising:

a sensor mountable on a body of the archery bow, the sensor sensing at least one of a first movement of an archery arrow with respect to the archery bow and a second movement of the archery bow, the sensor transmitting an input signal upon sensing at least one of the first movement and the second movement; and an electronic module housed within the body of the archery bow, the electronic module including a receiver for receiving the input signal transmitted by the sensor, a signal processor in communication with the receiver for processing the input signal and generating an output signal, the archery component in responsive communication with the output signal and activatable in response to the output signal, and a transducer transmitting a signal to the signal processor in response to the receiver receiving the input signal from the sensor.

11. The archery component of claim 10 wherein the signal processor is housed within a riser portion of the archery bow.

12. The archery component of claim 10 further comprising a power source housed within the body of the archery bow and electrically connected to the electronic module.

13. The archery component of claim 10 further comprising a wire electrically connecting the sensor to the signal processor and transmitting the signal from the sensor to the signal processor, at least a portion of the wire positioned within a passage formed in the archery bow.

14. The archery component of claim 10 further comprising a power source housed within a body of the archery bow and operatively connected to the signal processor.

15. The archery component of claim 10 further comprising a release element operatively connected to the signal processor and moving the arrow rest between an arrow support position and an arrow release position in response to the received signal.

16. The archery component of claim 15 wherein the release element comprises at least one of an electric motor, a linear actuator, a hydraulic piston, a pneumatic piston, a solenoid, a spring, a battery, a capacitor, an inductor, a fuel cell, a hydraulic accumulator, a supply of a compressed gas, at least one reactable chemical component and at least one combustible material.

* * * * *